US007704119B2

(12) United States Patent
Evans

(10) Patent No.: US 7,704,119 B2
(45) Date of Patent: Apr. 27, 2010

(54) REMOTE CONTROL GAME SYSTEM WITH SELECTIVE COMPONENT DISABLEMENT

(76) Inventor: Janet E. Evans, 11225 Chase Ct., Westminster, CO (US) 80020

( * ) Notice: Subject to any disclaimer, the term of this patent is extended or adjusted under 35 U.S.C. 154(b) by 718 days.

(21) Appl. No.: 11/061,074

(22) Filed: Feb. 18, 2005

(65) Prior Publication Data

US 2005/0186884 A1 Aug. 25, 2005

Related U.S. Application Data

(60) Provisional application No. 60/545,867, filed on Feb. 19, 2004.

(51) Int. Cl.
*A63H 30/00* (2006.01)

(52) U.S. Cl. ..... 446/454; 463/52

(58) Field of Classification Search ..... 446/454–456; 434/22, 23

See application file for complete search history.

(56) References Cited

U.S. PATENT DOCUMENTS 5,788,500 A * 8/1998 Gerber ..... 434/22
6,386,879 B1 * 5/2002 Varshneya et al. ..... 434/16
6,497,608 B2 * 12/2002 Ho et al. ..... 446/456
6,949,002 B2 * 9/2005 Yamaguchi et al. ..... 446/454
2001/0045978 A1 * 11/2001 McConnell et al. ..... 348/42
2005/0085159 A1 * 4/2005 Yamaguchi et al. ..... 446/454

* cited by examiner

*Primary Examiner*—Peter DungBa Vo
*Assistant Examiner*—Alex F. R. P. Rada, II
(74) *Attorney, Agent, or Firm*—Lathrop & Gage LLP

(57) ABSTRACT

A remote control game system comprises two or more game sets, each game set having one or more remote control vehicles and an associated control console. Each of the remote control vehicles comprises: a vehicle body; one or more offensive components mounted with the vehicle body; each of the offensive components operable to communicate at least one offensive signal; one or more sensors mounted with the vehicle body, each of the sensors operable to detect the offensive signal, and in response, to generate a hit signal; and one or more drive components. The drive components are (a) responsive to commands from the control console, to move the vehicle body and operate the offensive components, and (b) responsive to the hit signal to degrade operation of one or both of the vehicle body and offensive components.

21 Claims, 12 Drawing Sheets

REMOTE CONTROL GAME SYSTEM WITH SELECTIVE COMPONENT DISABLEMENT

CROSS-REFERENCE TO RELATED APPLICATIONS

This application claims the benefit of priority of U.S. Provisional Patent Application No. 60/545,867, filed 19 Feb. 2004 and incorporated herein by reference.

BACKGROUND

Remote control devices provide enjoyment to their users by responding to user commands. Directing complex actions is more interesting than directing simple ones. In certain prior art remote control devices, such as BattleBots©, vehicle damages are apparent when physical collisions occur; and then the damaged vehicle must be repaired. Video games, on the other hand, simulate destruction of vehicles and objects; however video games do not utilize remote control devices.

SUMMARY OF THE INVENTION

In an embodiment, a game system with selective component disablement is provided wherein individual remote control vehicles (e.g., a tank) are capable of generating offensive signals (i.e., "firing" on one another), receiving such signals in selected areas (i.e., to identify being "hit"), and have selectively disabling components (i.e., displaying "injury"), depending on the area that receives the signal. Selectively disabling components appeals to game participants because it is a more realistic response to being hit as compared to disabling all vehicle functions of a toy after one or a number of "hits." A control console operates to send remote control commands and receive information from the remote controlled vehicles; it also may calculate a score based on game-related quantities. These game-related quantities are for example numeric quantities that are recognized by the players as appropriate to the vehicle and the context in which it operates, such as "shots fired", "type of shot", "hits", "misses", "injuries", "kills", "fuel", and "ammunition."

DETAILED DESCRIPTION OF THE DRAWINGS

Figure 1:
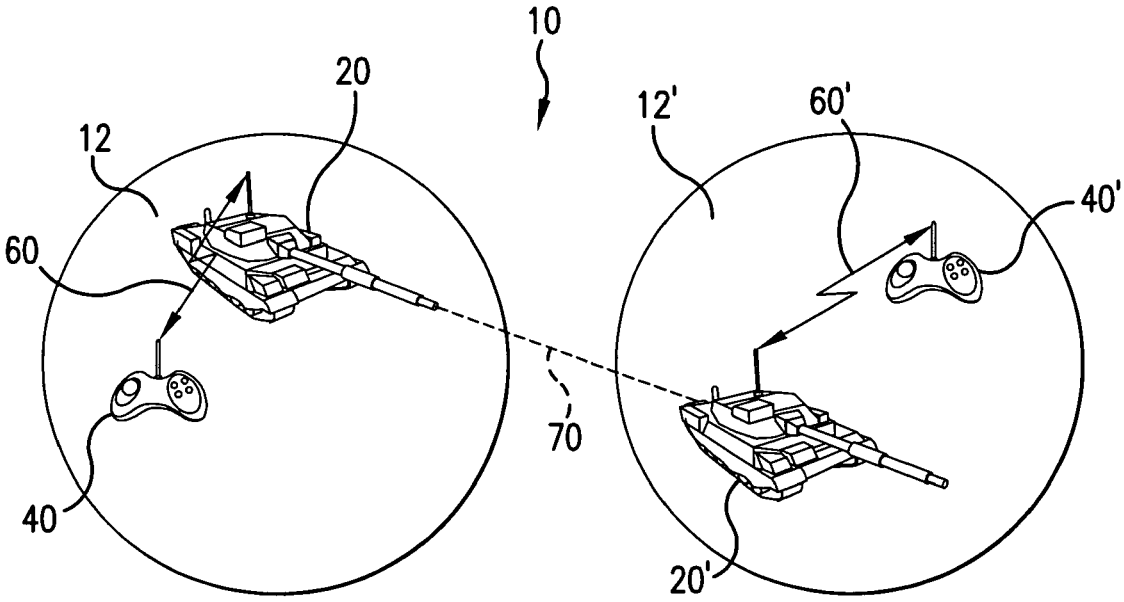
FIG. 1 shows one remote control game system with selective component disablement, in accord with an embodiment.

FIG. 1 shows one remote control game system 10 with selective component disablement. System 10 is shown with two sets 12, 12' of remote control toys and control consoles. Specifically, set 12 includes a vehicle 20 and a control console 40 communicating via wireless signals 60, and set 12' includes a vehicle 20' and a control console 40' communicating via wireless signals 60'. Wireless signals 60 and 60' may be unique to sets 12 and 12' respectively, (e.g., control console 40 communicates solely with vehicle 20 and not vehicle 20'). Each vehicle 20, 20' is capable of emitting and receiving offensive signals, as discussed in more detail below. In FIG. 1, vehicle 20 is shown emitting an offensive signal 70 that strikes vehicle 20'.

Figure 2:
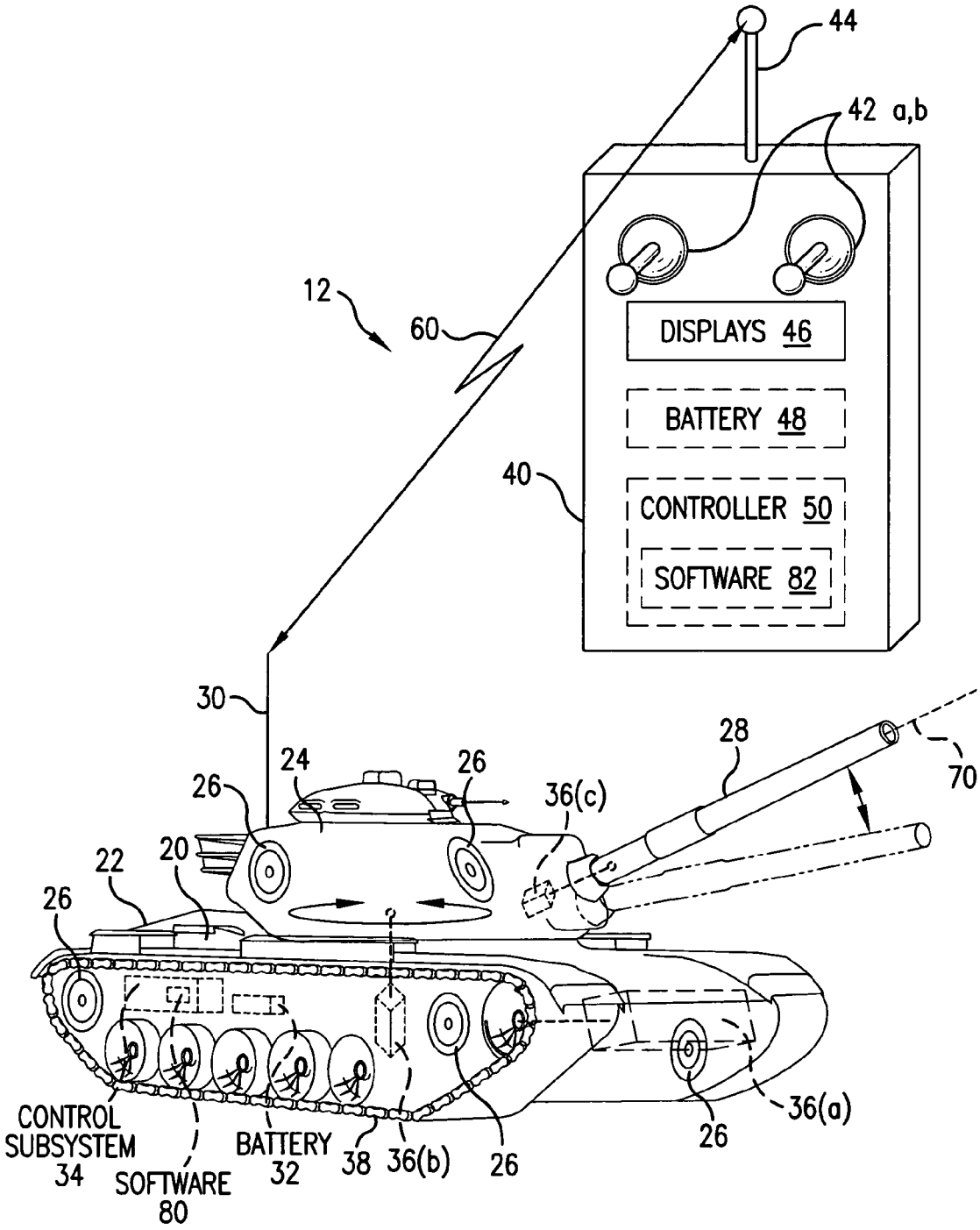
FIG. 2 shows exemplary detail of the remote control game system of FIG. 1.

FIG. 2 shows exemplary detail of set 12 of the remote control game system of FIG. 1. Set 12 includes one vehicle 20 and one control console 40, as shown. In the embodiment of FIG. 2, vehicle 20 is in the form of a tank and includes a vehicle body 22, a turret 24, one or more sensors 26, a gun 28, an antenna 30 (to send and receive radio frequency signals 60), and drive components 36. Within vehicle body 22, a battery 32 powers vehicle 20, and a control subsystem 34 contains operational software 80.

In particular, vehicle body 22, turret 24, and gun 28 simulate a tank, and drive component 36(*a*) moves the tank via treads 38. Turret 24 rotates relative to vehicle body 22, through operation of drive component 36(*b*), and gun 28 moves upon turret 24, through operation of drive component 36(*c*). Gun 28 is operable as an offensive component; in one embodiment it emits ("fires") an infrared laser as offensive signal 70 (a "shot"). Sensors 26 receive offensive signals 70 (from other vehicles 20 of the current game) and, in response thereto, send signals (hereafter called "hit signals") to control subsystem 34. Antenna 30 communicates wireless signals 60 (e.g., information about the hit signals) to and from control console 40.

Through control console 40, a player may control the movement and offensive components of vehicle 20. Controller 50 may be programmed with software 82 that is for example modifiable or replaceable through memory sticks, cards, proms, or a communication port on control console 40 (through which controller 50 may be connected to a computer or network). Control console 40 further includes player controls 42, an antenna 44 (to send and receive wireless signals 60), displays 46, and a battery 48. Player controls 42 may include buttons, triggers, joysticks, trackballs and/or similar mechanisms. Player controls 42 may also include keyboards or keypads, enabling input of alphanumeric data.

Display 46 may be, for example, an LCD, indicator lights, LEDs, alphanumeric displays, and/or devices capable of displaying graphics or images produced by cameras. Display 46 may also include an audio device such as a buzzer or speaker. Display 46 may also interact with player control 42, i.e., forming a graphical user interface (hereafter called a "GUI"). In the GUI, a screen may present an image representing one or more controls, such that a player may direct actions through player controls 42, such as a joystick, trackball, mouse, to move a cursor within the display, to a place designating the desired action, and activate the selected action using, for example, buttons or switches of player controls 42.

Control subsystem 34 controls the drive components 36 of vehicle 20 in response to movement or firing commands from control console 40 and hit signals from sensors 26. Control subsystem 34 is programmed with software 80. Software 80 may reside in fixed firmware, or it may be modifiable or replaceable similar to software 82. In one embodiment, control console 40 transmits replacement software to control subsystem 34 through wireless signals 60.

By way of illustrative operation, a player operating one or more player controls 42 on control console 40 initiates a game. After initiating a game, for example, the player continues to operate his player control 42, which causes control console 40 to issue movement or firing commands over radio frequency signals 60; a vehicle 20 receives the signals. In the absence of hit signals, each control subsystem 34 responds to movement or firing commands received from control console 40 by issuing motion control signals, to one or more of drive components 36(*a*)-(*c*), or to gun 28. Accordingly, the tank acts as a radio controlled vehicle, and a player can see the effect of his/her manipulation of the controls upon the vehicle.

When a sensor 26 receives an offensive signal 70, it transmits a hit signal to control subsystem 34 (the receiving of an offensive signal and transmission of a hit signal may be denited as a "hit" herein). When hit, the appropriate control subsystem 34 in turn modifies the signals that it would otherwise send to the drive components 36, or offensive components such as gun 28, for some period of time, or indefinitely for the game (modification of signals sent to drive components, offensive components, or other components after a hit may be denoted as "injury" herein). The manifestation of injury may vary depending upon user preference. For example, single hits on certain sensors may cause temporarily degraded operation or disablement of only one drive component 36, or suspension of firing signals to offensive components such as gun 28. Hits on other sensors, or multiple hits, may result in longer disablement of components, or the complete disablement of remote control vehicle 20 for the duration of the game.

Alternatively, the processes of administering injury in response to a hit can be performed by controller 50 of control console 40, instead of control subsystem 34 of vehicle 20. In this embodiment, after any sensor 26 is hit, control subsystem 34 transmits a wireless signal to control console 40 denoting which sensor 26 was hit. Controller 50 performs the function of determining consequences of the hit, and modifies any attempt by a player to send movement or firing commands to affected drive component(s) 36 or offensive components (such as gun 28) during the period of the injury. In this embodiment, control subsystem 34 receives incoming movement or firing commands and executes them.

Vehicle 20 may have movable parts whose range of motion is limited. These movable parts may be equipped with limit switches connected with the control subsystem 34 of vehicle 20, to detect reaching this limit, so that the drive components 36 for these parts can be turned off to avoid damage to vehicle 20. Software 80 may contain provisions for sending limit switch messages over wireless signals 60 to control console 40, so that a player knows why a movable part does not respond to commands to move further.

Game-related quantities are numeric variables with values set at the beginning of a game, for example, and which may change as the game progresses. For example, game-related quantities may include time played or time remaining in a game, shots fired, and hits received, and/or a score of "points" earned. The number of hits received on specific sensors or groups of sensors during a game may accumulate in "hit counters". Control console 40 may operate to calculate game-related quantities and display them on one or more displays 46.

Another game-related quantity that may be used is "ammunition," which starts at a defined level at the beginning of a game and is depleted by a shot whenever a shot is fired. The exhaustion of ammunition results in the inability of a corresponding offensive component to emit offensive signals 70. Vehicles 20 may be equipped with more than one type or quantity of offensive component (e.g., two or more guns 28), or other components capable of emitting offensive signals 70. In such cases, another game-related quantity may be "type of shot," i.e., use of a particular offensive component requires availability of a correct type of ammunition, causing a particular type or degree of injury.

Another game-related quantity that may be used is "fuel," which starts at a defined level at the beginning of a game and which is depleted over time or whenever vehicle 20 uses drive components 36, or both. The quantity of ammunition or fuel are subject to adjustment for other reasons as the game progresses. For example, a vehicle 20 that achieves certain objectives in a game may receive extra ammunition or fuel. The examples of ammunition and fuel are intended as illustrative, and do not limit the game-related quantities that may be implemented using remote control vehicles 20 and control consoles 40.

Game-related quantities, alone or in combination, may be used to define "events," which may also define game-related quantities. For example, events may include the complete depletion of ammunition or fuel, inflicting or receiving a certain number of hits, or the total disablement ("death") of a vehicle 20. Another type of event may include completing a predefined set of game objectives, resulting in an award of extra points, fuel, or ammunition. Software 82 may be configured to indicate the occurrence of events on display 46, so that, for example, audio display 46 emits specific sounds in response to specific events.

An offensive signal 70 may contain other physical phenomenon generated by an offensive component and received by a sensor. For example, instead of an infrared laser, a light source (e.g., a red laser) and a light sensor may be used. Sound or radio waves can alternatively be used as offensive signals 70. Physical projectiles may also be used as offensive signals; even the body or parts of vehicles 20 may be used as offensive components (e.g., as ramming devices). In one embodiment, vehicles 20 are equipped with sensors (e.g., accelerometers) that interpret physical contact as a hit.

In one embodiment, control consoles 40 and vehicles 20 communicate with each other, (i.e., instead of a single vehicle 20 communicating with a single control console 40). In this embodiment, transmissions include encoded information identifying the source of the transmission, and control consoles 40 and/or vehicles 20 operate to decode this information (for example, so that when a player operates a control, the appropriate vehicle 20 responds). This mode of communication enables more sophisticated scorekeeping, and other features, for increased player enjoyment. For example, control consoles 40 may transmit score information to each other so that each player's control console displays not only the player's score, but also his/her opponent's score(s). Further, a control console 40 may inform the user that the vehicle 20 under its control has fired a shot, and/or may determine whether an opponent's vehicle 20 has suffered a hit, to classify a shot as a hit or a "miss" (i.e., a shot that does not hit a sensor). A control console 40 may calculate scores differently, and/or vary its display 46, based on hit or miss information.

In another embodiment, an offensive signal 70 provides encoded (e.g., modulated) information identifying the type of vehicle 20 or offensive component firing the signals, and sensors 26 or vehicle control subsystems 34 operate to decode this information. This information enables a vehicle 20 to display different levels of injury depending on the type of offensive component inflicting a hit. Including such information also helps vehicles 20 and control consoles 40 distinguish offensive signals 70 from background noise sources (e.g., if played outdoors and offensive signals 70 are light beams, the encoded information distinguishes the offensive signals 70 from sunlight). Alternatively, control console 40 correlates the time of one vehicle 20 firing a shot, and what type of shot occurred, to the time another vehicle's sensor 26 was activated, to distinguish a hit from background noise.

A control console 40 may control more than one vehicle 20. In such an embodiment, a player to selects one or more specific vehicle(s) 20 at a time, to receive a movement or firing command. Such a control console 40 may keep scores and other game-related quantities for individual vehicles 20, or a single score for multiple vehicles 20 acting as a team under its command, for example. Or a player may control more than one vehicle at a time, for example.

Figure 3:
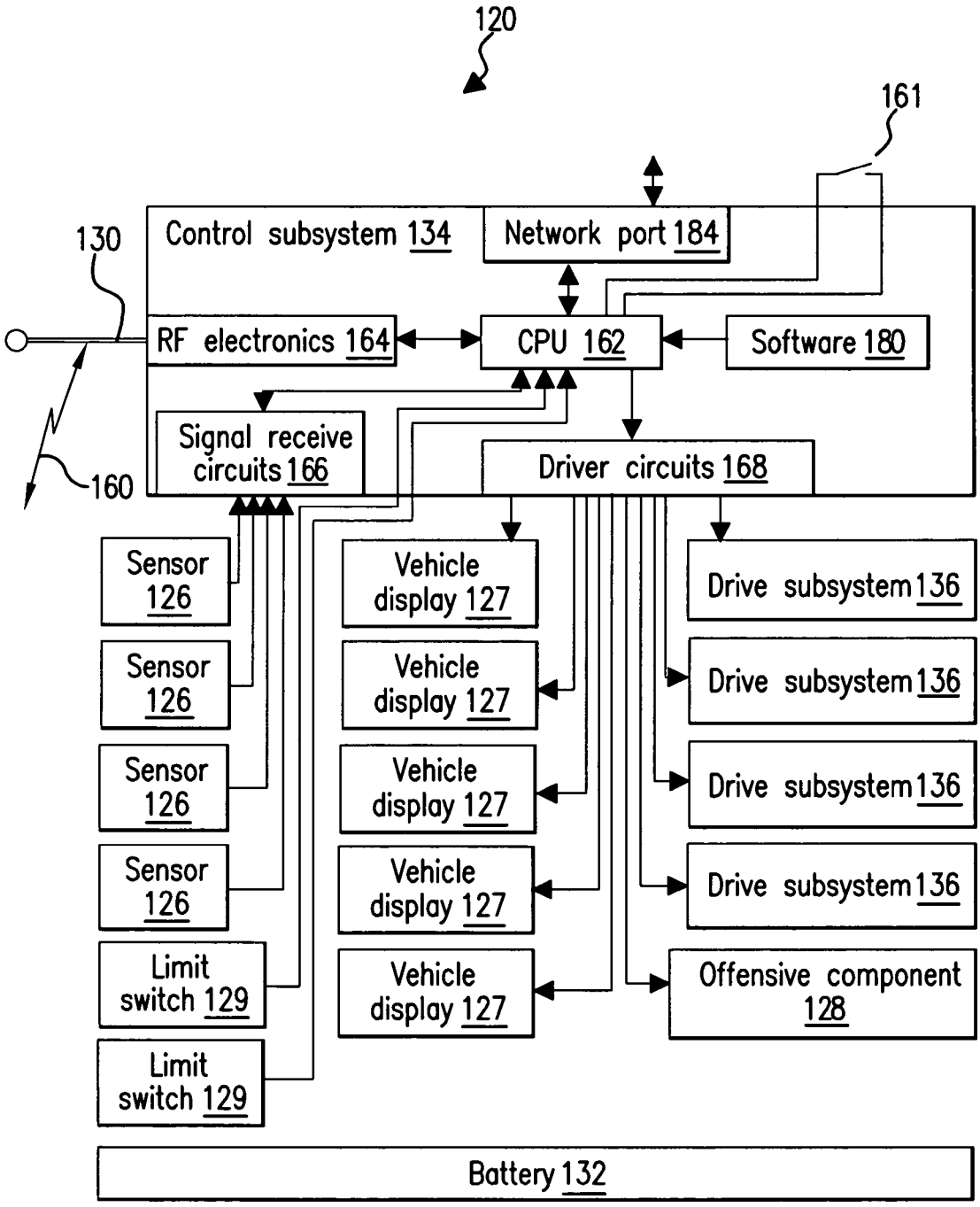
FIG. 3 shows exemplary elements of a vehicle utilized with a remote control game system with selective component disablement, in accord with an embodiment.

FIG. 3 shows exemplary interrelation of elements within for a vehicle 120 of a remote control game system with selective component disablement, in accord with an embodiment. Vehicle 120 has a control subsystem 134, an antenna 130 (to radiate or receive wireless signals 160), an on/off switch 161, one or more sensors 126, one or more vehicle displays 127, one or more limit switches 129, one or more drive components 136, one or more offensive components 128, and a battery 132. Control subsystem 134 has a central processor ("CPU") 162, radio frequency ("RF") electronics 164, signal receive circuits 166, driver circuits 168, software 180, and a network port 184. Battery 132 connects to elements within vehicle 120, as needed, for power (the connections of battery 132 are omitted within the drawing, for clarity).

Sensors 126 may be analog or digital sensors; vehicle 120 may include both types. An exemplary analog sensor is for example an accelerometer, which may be used to detect physical contact with another vehicle; an exemplary digital sensor is for example a charge coupled device (CCD) to detect visible laser signals 70 or a bolometer to detect infrared signals 70. Each sensor 126 connects to an appropriate signal receive circuit 166. Signal receive circuits 166 for analog sensors convert the analog signal to digital data for CPU 162. In the embodiment of FIG. 3, each sensor 126 is illustratively located adjacent to a vehicle display 127 on the body of vehicle 120.

Vehicle 120 may be turned on by closing on/off switch 161. When this occurs, CPU 162 loads instructions from software 180, to configure CPU 162. Thereafter, CPU 162 remains under the control of software 180 during a game. The configuration of CPU 162 may include definitions of states that vehicle 120 is in at a given time, corresponding either to normal operation or injury, as previously described. The state of vehicle 120 is continuously provided to those driver circuits 168 which correspond to vehicle displays 127. Vehicle displays 127 may include two LEDs, for example a green one and a red one.

Driver circuits 168 provide appropriate currents or voltages for operating the vehicle displays 127 or drive components 136 to which they connect. For example, after vehicle 120 is turned on, it may assume a normal operation state, with all of the vehicle display 127 green LEDs lit, and with all drive components 136 operable.

When CPU 162 receives data from the signal receive circuit 166 of a sensor 126 indicating a hit, CPU 162 may change the state of vehicle 120 to a particular injured state, corresponding to the sensor that received the hit (and, as appropriate, the number of hits received at the sensor). This change in state, if occurring, causes driver circuit 168 for vehicle display 127, adjacent to the "hit" sensor, to modify its output to the vehicle display, turning off the green LED and turning on the red LED, for example. During the injured state, if commands from a control console are received, CPU 162 either sends no data to driver circuit 168 corresponding to the injured drive component 136 (or offensive component 128), or sends data corresponding to degraded operation. CPU 162 may also track the duration of the injured state, and return vehicle 120 to its normal operation state after a preset period. Re-entering the normal operation state may cause the appropriate driver circuit 168 to turn off the red LED and turn on the green LED of vehicle display 127, for example. Re-entering the normal operation state may further cause driver circuits 168 to resume sending normal signals to drive components 136 and/or offensive components 128 upon receiving commands from a control console.

Game data transmitted by vehicle 120 may include reporting of hits or limit switch messages, periodic reporting on the state of vehicle 120 (e.g., normal operation or injured), responses to queries from the control console (e.g., asking whether a hit has been received) or other information available to CPU 162. CPU 162 may be configured to pass game data to RF electronics 164, whereupon RF electronics 164 converts game data to RF electronic signals, amplifies the signals, and broadcasts them as wireless signals 160 through antenna 130, thus making game data available to control console(s), other vehicle(s), and other game components or subsystems.

When a control console, another vehicle, or another game entity such as a game area controller (see FIG. 5) transmits wireless signals 160, the signals are received by vehicle 120 through antenna 130, and pass as RF electronic signals into RF electronics 164. RF electronics 164 decode digital data from the RF electronic signals and transmits this data to CPU 162. The response of CPU 162 to data indicating a motion or firing command is dependent on the state of vehicle 120. If vehicle 120 is in the normal operation state, CPU 162 sends data to a driver circuit 168 corresponding to a command to move or to fire an offensive component. The driver circuit 168 then converts the digital data received from CPU 168 to appropriate voltage or current levels to operate drive component(s) or offensive component(s) connected with the drive circuit. But if the component whose action is requested is in an injured state, then CPU 162 does not send data corresponding to a normal motion or firing command, but instead sends no data, or data corresponding to a degraded motion or firing command, to the appropriate driver circuit 168.

Certain drive components 136 such as tank treads or wheels can move a vehicle 20 in a certain direction for a prolonged period. Others may have limited ranges of motion (e.g., gun elevation or turret rotation). Limit switches 129 serve to inform CPU 162 whenever a drive component 136 with a limited range of motion is driven to its limit. Upon detecting any limit switch in a state corresponding to a motion limit, software 180 causes CPU 162 to cease sending data to driver circuit 168 corresponding to the affected drive component 136. Software 180 may also configure CPU 162 to send a message to a control console to inform a player that a limit has been reached.

Receipt of control signals from a control console may also change the state of vehicle 120. For example, upon completion of a game, a control console may send a reset signal to vehicle 120 to restore it to the normal operation state.

In the embodiment of FIG. 3, the locations of vehicle displays 127 may coincide with the locations of sensors 126, to provide a visual indication of a hit on vehicle 120. In other embodiments, vehicle displays 127 may simulate appearance of smoke. Vehicle displays 127 may also operate coincidentally with use of offensive components (e.g., by simulating a muzzle flash upon firing a gun). Vehicle displays 127 may also include audio devices such as buzzers or speakers, for example to provide sound effects such as firing or explosion sounds. Vehicle displays 127 may also include lighting that serves to obscure sensors 126. For example, a vehicle display 127 that is a visible light may be adjacent to a sensor 126 on a vehicle 120, thus obscuring or making it difficult for an opposing player to see the sensor 126, thus making it difficult for the opposing player to aim an offensive signal 70 accurately enough at the sensor 126 to score a hit.

Network port 184 allows CPU 162 to interface with networks (e.g., the Internet). Software 180 may include communication software to allow upload or download of game data, or download of software modules or replacement software through network port 184. Alternatively, control signals issued by a control console may include instructions to receive a partial or complete software replacement over wireless signals, after which CPU receives and stores replacement software 180 transmitted from the control console.

Figure 4:
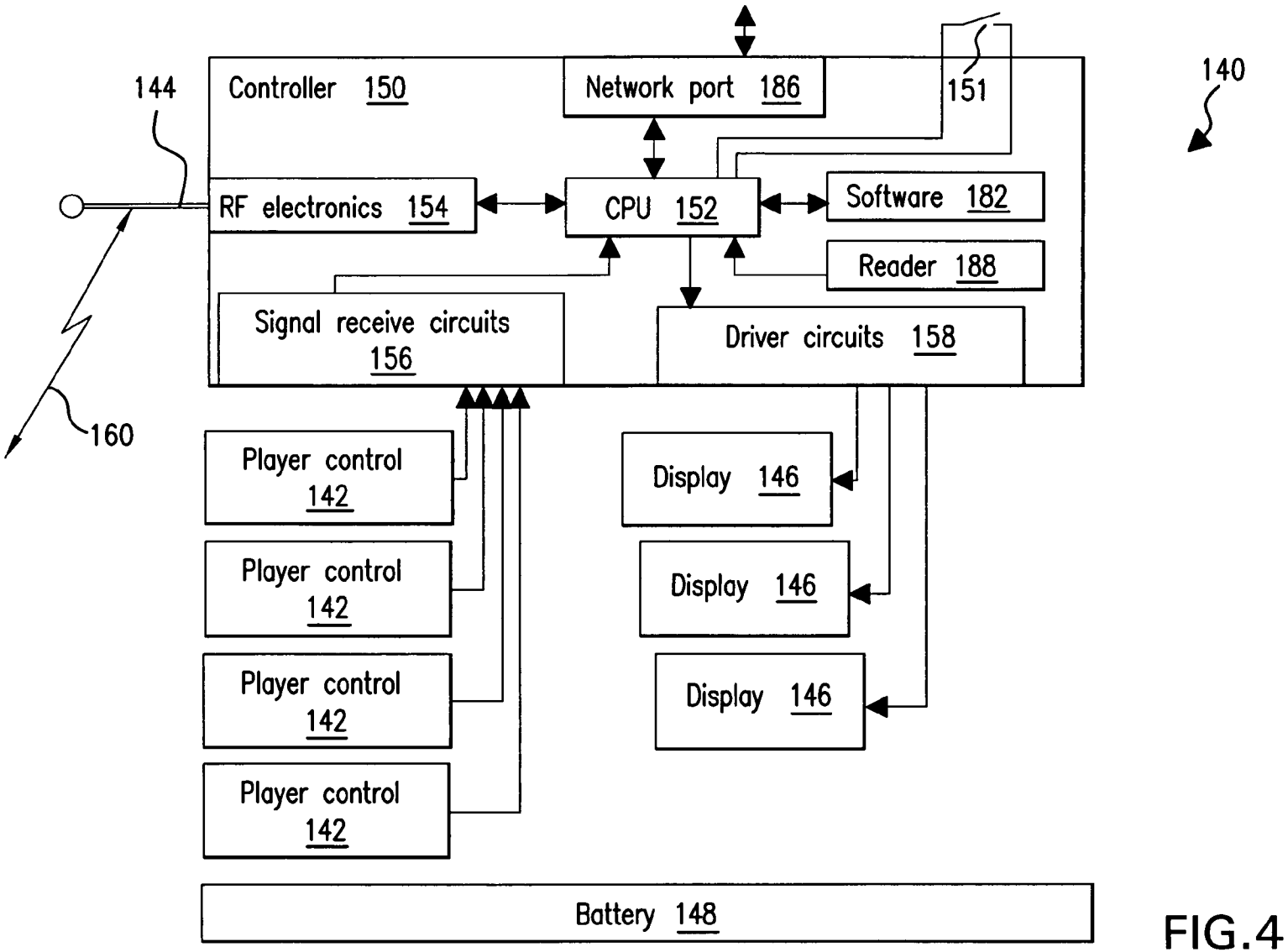
FIG. 4 shows exemplary elements within a control console of a remote control game system with selective component disablement, in accord with an embodiment.

FIG. 4 shows exemplary interrelation of elements within one control console 140 of a remote control game system with selective component disablement, in accord with an embodiment. Control console 140 has a controller 150, an antenna 144 (to transmit or receive wireless signals 160), an on/off switch 151, one or more player controls 142, one or more displays 146, and a battery 148. Controller 150 has a central processor ("CPU") 152, RF electronics 154, signal receive circuits 156, driver circuits 158, software 182, a network port 186, and a reader 188. Player controls 142 connect to appropriate signal receive circuits 156, which convert analog output of player controls 142 to digital form and pass the data to CPU 152, or form direct connections to CPU 152. Battery 148 connects to elements within control console 140 as needed for power (the connections of battery 148 to these elements are omitted within the drawing, for clarity).

When control console 140 is turned on by closing on/off switch 151, CPU 152 loads instructions from software 182 to configure CPU 152, for execution of commands, and provides data to driver circuits 158 to enable activation of displays 146. Thereafter, CPU 152 continues to execute instructions of software 182 to facilitate use of the game system. For example, upon receiving data from signal receive circuits 156, or data received through antenna 144 and RF electronics 154, CPU 152 sends movement or firing commands to RF electronics 154 for broadcast to a vehicle, or sends data to driver circuits 158 to update displays 146. CPU 152 may also operate to send data to RF electronics 154 or driver circuits 158 in the absence of data receipt; for example, CPU 152 may act as a timer to continuously update time related data by sending such data to driver circuits 158 to update displays 146.

Network port 186 optionally allows CPU 152 to interface with networks (e.g., the Internet). Software 182 may include communication software to allow upload or download of play data, or download of software modules or replacement software. Software 182 may further be capable of configuring CPU 152 to perform a remote upgrade of software 180 for vehicle 120 through the following exemplary steps: (1) downloading software 180 for vehicle 120 through network port 186, (2) transmitting control signals to vehicle 120 through wireless signals 160 to configure vehicle 120 for the receipt of software, and (3) transmitting software 180 to vehicle 120 over wireless signals 160. Reader 188 is a device capable of receiving data and/or software from media such as magnetic or semiconductor based memory cards (see FIG. 6).

The sensitivity characteristics of sensors 26, 126 may vary. For example, a sensor 26, 126 (such as a CCD) capable of receiving/detecting light may be mounted on the surface of a vehicle 20,120, making it sensitive to receiving light from a wide angle, or it may be recessed inside a niche on the body of vehicle 20, 120, or partially obscured by mechanical structure such as shutters, making it more difficult to hit. In another example, a sensor 26, 126 may be sensitive to certain wavelengths of light, and the set of wavelengths which operates to activate a sensor 26, 126 may be adjusted (e.g., by placing or removing a filter over the sensor, for example). Drive components 36, 136 may serve to move sensors from one of these positions to another, or to manipulate shutters, filters, or other mechanical obscuring devices, in response to commands from control subsystem 34, 134. In this case, sensitivity characteristics of sensors 26, 126 are adjustable in response to play events (e.g., certain hits might result in an increase of sensitivity for certain sensors 26, 126, increasing the vulnerability of vehicle 20, 120). Or, manual manipulation of filters, sensor positions, shutters, or other mechanical obscuring devices may serve to adjust sensitivity characteristics. The effective sensitivity of a vehicle 20, 120 to hits may also be adjusted through electronic means within control subsystems 34, 134. For example, in response to play events, a CPU 162 may interact with one or more signal receive circuits 166 to change the sensitivity of a signal receive circuit 166 to analog input supplied by a corresponding sensor 26, 126, or CPU 162 may increase or decrease a digital data value received from a signal receive circuit 166 to count as a hit.

Certain embodiments also vary the efficacies of the offensive components. For example, control subsystem 34, 134 may adjust the power output of an infrared laser by adjusting the power delivered from a driver circuit 158. Position of a laser may be manipulated with respect to the end of a gun 28, 128, modifying the width of the laser beam. Mechanical structures may partially block the laser beam, or optical devices may alter the characteristics of the laser beam. Drive components 36, 136 and/or driver circuits 158 may make these adjustments to the operating characteristics of the offensive components, in response to commands from control subsystem 34, 134. In this embodiment, efficacies of offensive components are adjustable in response to play events (e.g., the effect of certain hits might be to decrease the efficacy of certain offensive components, reducing the threat posed by a vehicle 20, 120). Manual manipulation of laser positions, shutters, and other mechanical or optical devices may serve to adjust the efficacies of offensive components.

Other operating characteristics of vehicles 20, 120 may also be varied, such as the speed at which drive components 36, 136 operate, the range of motion of swiveling or tilting components such as turret 24 or gun 28, 128, and/or the speed with which drive components 36, 136 react in response to operation of player controls 42, 142.

The characteristics of sensors 26, 126, the offensive components, the speed and response rate of a vehicle 20, 120 and any other adjustment of attributes of vehicles 20,120 may form sets of characteristics defining levels of difficulty. For example, a low level of difficulty may include one or more characteristics such as full range of motion of components such as turret 24 or gun 28, 128, moderate speed of drive components 36, 136, fast response of drive components 36, 136 to player controls 42, 142, high power and/or a wide beam for offensive signals 70, and/or low sensitivity of sensors 26, 126. A high level of difficulty may include one or more characteristics such as limited range of motion of components such as turret 24 or gun 28, 128, very low (or very high) speed of drive components 36, 136, delayed response of drive components 36, 136 to player controls, low power and/or narrow beam for infrared offensive signals 70, and/or high sensitivity of sensors 26, 126. Multiple players in a game may choose to play at the same difficulty level, or some players may sustain handicaps by the imposition of a higher level of difficulty on those players, compared to others. Achievement of certain game objectives might result in one or more changes of difficulty level within a game.

In one embodiment, objects exist in the area in which vehicles 20, 120 operate, and these objects may interact with vehicles 20, 120. For example, fixed or mobile targets (hereafter called "practice targets") may be operable to receive offensive signals 70, to sense a hit in the same manner as described herein for vehicles 20, 120. Practice targets may also include displays operable to change color, flash, or emit sound or smoke in response to a hit, and/or operate to provide information to vehicles and/or control consoles about hits for scoring purposes. Practice targets may include control subsystems and software that operate to direct the motions or other characteristics of the targets in random or pre-programmed ways.

There may be fixed or mobile weaponry (hereafter called "practice weapons") that emit offensive signals 70 compatible with the sensors 26 on vehicles 20, 120. Practice weapons may give visual or audible indication of their firing, and/or operate to provide information to vehicles and/or control consoles about firing, for scoring purposes. Practice weapons may include control subsystems and software that operate to direct the motions or other characteristics of the weapons in random or pre-programmed ways. Practice targets and weapons may be associated with one another, and the operation of each may correlate with the other, (e.g., hitting a practice target may temporarily or permanently 'injure' an associated offensive component of a practice weapon, in like manner as hits temporarily or permanently injure components of vehicles 20, 120). Inert obstacles, or mobile items which are not operable to send or receive offensive signals 70, but which serve to block them, may also exist in the area in which vehicles 20, 120 operate.

In one embodiment, a controller 50, 150 is loaded with a preset list of commands (hereafter called "battle plans") for transmission to vehicles 20, 120 at the start of a game. Players of this embodiment compose battle plans ahead of time and download them into a controller 50, 150 through a network port 186 before a game begins, or compose them directly on controller 50, 150. Vehicles 20, 120 executing battle plans may play against any combination of other vehicles 20, 120 executing battle plans, other vehicles 20, 120 operated by a player, or practice targets and/or weapons.

Embodiments of the game system may be modular, and items described herein may consist of added, removed, or replaced modular features. For example (referring to FIG. 2), one assembly may include turret 24, gun 28, associated drive components 36 and sensors 26; it may be replaced by another assembly with a different appearance or operating characteristics (e.g., one which fires projectiles instead of a laser, or includes multiple offensive components in place of a single one). Software 80 and software 82 may also include modular features that support specific physical modular features.

Another example of a modular feature is, for example, a harness designed to fit over a radio controlled vehicle, thus converting the vehicle into a vehicle such as described herein, as the harness includes a control subsystem, an antenna, and some combination of offensive components, sensors, and/or immobilizers. The radio controlled vehicle then functions as one of the vehicles previously described (e.g., a vehicle 20 or 120). For example, its offensive components may fire on other vehicles; when any of its sensors is hit, its control subsystem administers injury by immobilizing a drive component of the vehicle for a preset time through the harness; and a control console 40 acts to control the vehicle, display a score related to the vehicle, etc.

Figure 5:
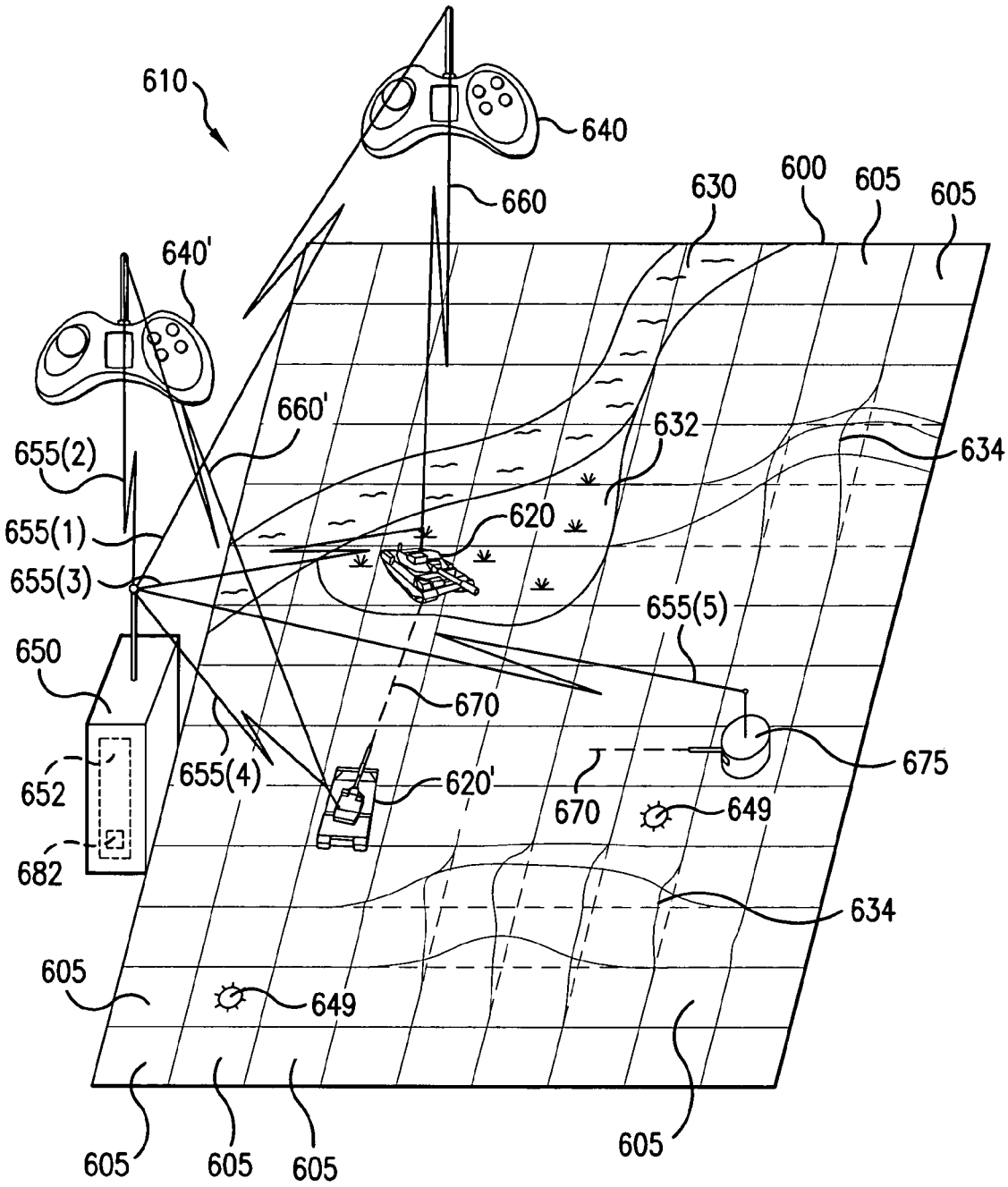
FIG. 5 shows one remote control game system with selective component disablement including a game area, in accord with one embodiment.

FIG. 5 shows one remote control game system 610 with selective component disablement, including a game area 600, in accord with an embodiment. Game system 610 includes a vehicle 620 communicating via wireless signals 660 to a control console 640, and a vehicle 620' communicating via wireless signals 660' to a control console 640'. In game system 610, control consoles 640, 640 track the position of vehicles within game area 600. For example, game area 600 is divided into sections 605; each section 605 includes a sensor (e.g., a pressure sensor or piezoelectric device) that identifies the presence of a vehicle (e.g., either of vehicles 620, 620') based on the vehicle's weight; the sensors communicate with game area controller 650. Game area 600 includes a CPU 652 and software 682, and transmits information about the position of each vehicle to control consoles and vehicles over wireless signals 655(1)-655(4). Wireless signals 655(1)-655(4) may be carried on different radio wavelengths (e.g., a radio wavelength of signals 655(1) and 655(3) may be the same as a radio wavelength of signal 660, and a radio wavelength of signals 655(2) and 655(4) may be the same as a radio wavelength of signal 660', so that the game area controller communicates on a radio wavelength that is particular to each combination of a vehicle and a control console). Alternatively, all of wireless signals 655(1)-655(4) may be on a common radio wavelength, with each transmission containing encoded information identifying each vehicle with its position information.

A game area (e.g., game area 600) is not limited to simulating a particular kind of terrain; it may instead simulate land, water, airspace, or extraterrestrial locations, for example. Simulated land areas may represent any type of terrain with respect to topography or surface type. For example, game area 600 illustratively includes simulations of a river 630, a swamp 632 and hills 634. Software 80, 180, 82, 182 and 682 may cooperate to simulate changes in the operation of vehicles due to the type of terrain on which a vehicle is located, (e.g., vehicles may move slower through swamps or rugged territory than on roads, and slower still through water). Inert obstacles such as hills 634 may serve to block offensive signals 670, thus providing cover for vehicles 620, 620'. Game areas may simulate the scenes of historic battles, and battle plans as previously discussed may effect reenactment of the actions of vehicles during the historic battles.

In other embodiments, game areas and/or vehicles may contain features that cooperate in other ways to determine the position of vehicles, and to communicate the position to control consoles, vehicles, and/or game area controllers. For example, in one embodiment, position features such as bar codes, magnets, or wires may be embedded in a game area; a vehicle may be equipped to sense the position features as a vehicle traverses thereby. Vehicles may transmit information about their identities to vehicle position sensors in a game area, and/or vehicles may determine their own position using dead reckoning from a starting point. A vehicle may determine its own position and communicate that position to at least one control consols; in such embodiments, a game area need not include a game area controller.

If the position of vehicles is determined and communicated to control consoles (hereafter called "position-enabled embodiments"), one of the control console displays may be a map of the game area, to indicate the position of the vehicle(s) on the map (hereafter called a "game area map display"). In the cases where all of the vehicles and controllers communicate with one another, the indicators of the vehicle(s) on the game area map display may also discern vehicles from each other, and include other game data. For example, particular symbols may identify "friend" and "enemy" vehicles, with game-related quantities such as points, ammunition, fuel, etc., shown adjacent to each symbol designating a vehicle.

The communication features of a game area (e.g., game area 600) may support advanced capabilities related to the use of practice weapons and practice targets. For example, in FIG. 5, wireless signal 655(5) allows game area controller 650 to transmit commands to a practice weapon 675, allowing a game designer to heighten interest of the players by determining an angle at which to aim weapon 675 so that it fires (emits offensive signal 670) in the direction of vehicles, rather than firing randomly. Also, practice weapons may include items such as mines 649 that operate to inflict hits based on proximity alone, rather than only when a sensor (e.g., sensor 26, 126) is hit. Software 682 may implement mines 649 on fixed positions in the game area, or on new positions each time a game starts. A mine 649 may inflict injury on a vehicle that runs directly over it, or one that merely passes within a preset distance.

Figure 6:
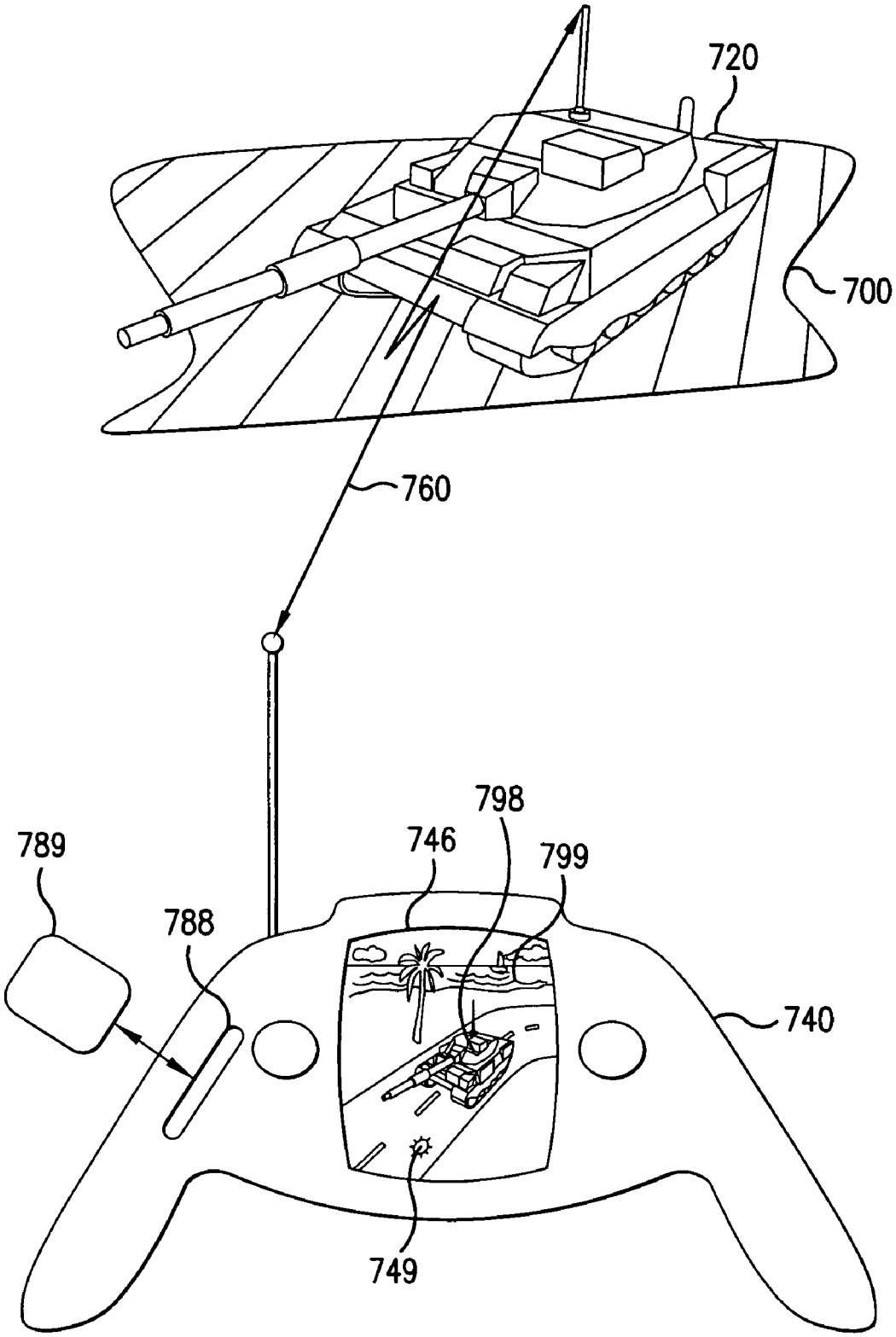
FIG. 6 shows a vehicle, on a floor surface, controlled by a control console in accord with an embodiment.

The features described with respect to game areas may also be applied virtually, e.g., by software within a control console, and without the requirement for an actual game area having physical capabilities as described above. For example, background image data may contain representations of maps or scenes, and a control console may present a user with a virtual game area map display, in the same manner as a game area map display as discussed above. FIG. 6 shows a vehicle 720, on a floor surface 700, with vehicle 720 being controlled through wireless signals 760 by a control console 740. Control console 740 also includes a reader 788 capable of loading background image data into control console 740 from memory card 789. The background image data may thus be used to form an image 799 corresponding to background scenery as viewed by a user of console 740. Image 798 of vehicle 720 is merged with image 799 and presented in display 746, as shown.

Background image data may also be used to form images of other objects, such as image 749 corresponding to a virtual mine, which also appears in display 746. Images may represent various operations and orientations of a vehicle, various backgrounds, types of terrain, obstacles, mines, or any other aspect of an imaginary battlefield, and software in control consoles may simulate the effects of such items as if they were physically present in the environment of a vehicle.

Software 80, 180 of vehicles and software 82, 182 of control consoles may cooperate to enable defensive capabilities for vehicles. Defensive capabilities are ways for a player to protect a vehicle in a specific way for a specific time period, in exchange for some game-related quantity (e.g., points, ammunition, or fuel). For example, a "shield" capability may provide protection against offensive signals 70, temporarily or throughout a game, by disabling the requirement that a vehicle that is hit respond by being injured, or by physically modifying the sensors to make them more difficult to hit. Or, in embodiments including mines, a "mine detector" capability may provide warning of the location of a mine before a vehicle is close enough for the mine to inflict a hit.

Position-enabled embodiments may also enable determination of the orientation of a vehicle (and any of its components, e.g., where its offensive components are pointed). This information is communicated to the control consoles. When the capability of determining and communicating orientation exists (hereafter called "orientation-enabled embodiments"), game area map displays may also indicate the orientation of vehicles and their offensive components. In orientation-enabled embodiments, one of the control console displays may, for example, show a representation of the game area as it would be seen from the vantage point of the vehicle, or one of its offensive components (hereafter called a "gunner's view rendering"). Like the game area map display, a gunner's view rendering may display symbols indicating the position and orientation of other vehicles, whether they are "friend" or "enemy" vehicles, and game-related quantities related to each vehicle. A gunner's view rendering may be a separate display on the control console; the system may also be configured so that a player may switch a display device between a gunner's view rendering and other views, for example.

Orientation-enabled embodiments may include game area map displays; gunner's view renderings may have controls that enable interaction with the game area map display and/or gunner's view rendering, e.g., as a GUI. When such a GUI is used, a player uses player controls to move cursors or pointers on the display to direct the activity of the vehicle(s) under his/her control. For example, the control console may (1) receive a command given by the player, (2) evaluate the position at which the player has placed the cursor, (3) compare this position to the current position or orientation of the vehicle or its offensive components, and/or (4) issue the appropriate command(s) to move the vehicle or its offensive components to the position or orientation indicated by the cursor.

Orientation-enabled embodiments may use a calculated trajectory to describe a simulated arc of an offensive signal. When an offensive component emits an offensive signal, one of the control consoles or control subsystems 34, 134 may calculate a trajectory for the offensive signal (as for a fired projectile acted upon by gravity in flight). A hit is deemed to occur only when the calculated trajectory intersects the location of one or more sensors 26, 126 of a vehicle. The calculated trajectory may also include allowance for the time taken for an offensive signal to travel the distance between the offensive component and the target. Accordingly, instead of offensive components acting in straight lines with instantaneous speed (i.e., the path of laser light), use of offensive components may require compensation for gravity and time over the distance crossed by a simulated fired projectile, adding complexity and realism to the game. Such embodiments may not require physical offensive signals, devices that fire them, or sensors designed to receive them. Instead, they may rely solely on information about vehicle positions and orientations, offensive component angles, speed of the simulated offensive signal, and other factors added as a matter of design choice (e.g., wind speed, or value of gravity if a game area simulates a non-Earth location). Further, a game area can simulate a selected distance so that arc trajectories of an offensive signal must vary with the distance in order to hit a target.

Figure 7:
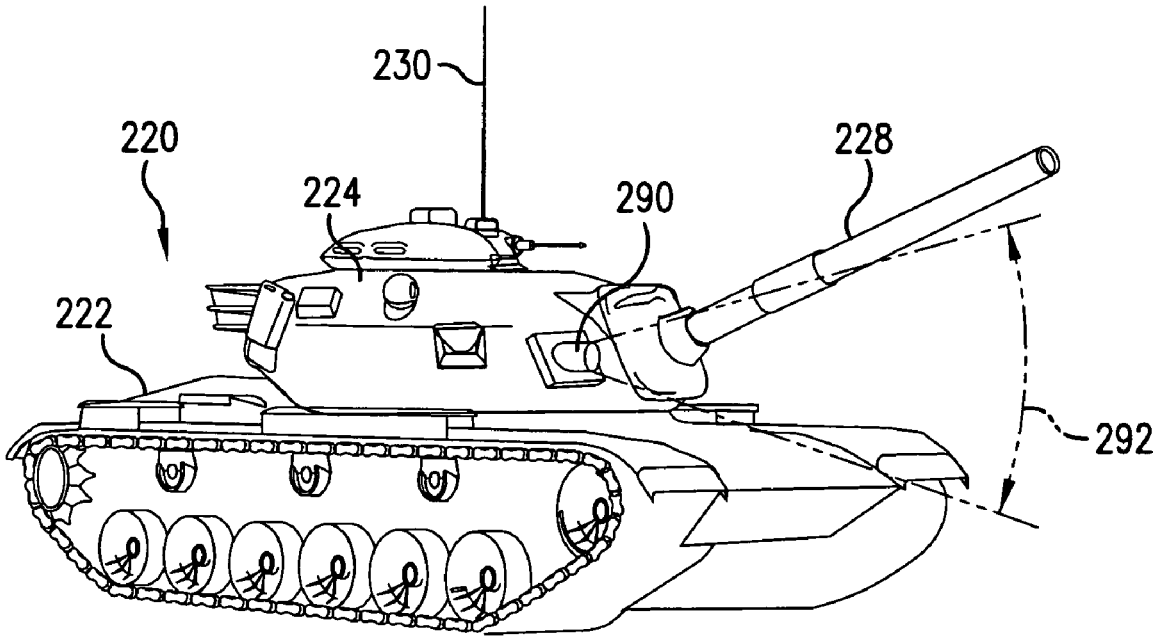
FIG. 7 shows a camera component mounted on a vehicle of one remote control game system with selective component disablement, in accord with an embodiment.

FIG. 7 shows a camera component 290 mounted on a vehicle 220 of one remote control game system with selective component disablement. In this embodiment, camera component 290 delivers image data to a control subsystem (e.g., control subsystem 34 of FIG. 2), which transmits the image data through antenna 230. Camera component 290 is mounted on turret 224 adjacent to gun 228, and delivers image data corresponding to a field of view indicated by arc 292.

Image data may be sent by a camera component 290 to a control subsystem for transmission through RF electronics which also transmit game data; or, the image data may be sent directly to a dedicated transmitter. If vehicles employ a camera component 290, the respective control console (e.g., control console 40 of FIG. 2) is, for example, capable of receiving the image data and displaying it on one or more displays. Camera components 290 may be affixed to the vehicle body or to one of its moving components, for example to provide a gunner's view image, as opposed to the gunner's view rendering on a graphics display. In FIG. 7, camera component 290 is mounted on turret 224 so that an image produced by the camera moves as the turret moves. Camera components 290 may have their own drive components allowing them to move within a range of motion, with these drive components controllable by the player through a control console. Camera components 290 may be capable of zoom magnification or other optical effects, also controllable by the player through the control console and control subsystem. Camera components 290 may be associated with sensors, so that a hit can render injury to the camera component, (e.g., causes degraded motion, or degraded optical capabilities, or a degraded image, or no image). Optical protection devices (e.g., filters, polarizers, or mechanical shades or apertures) may protect camera components 290 from unwanted or damaging optical noise sources such as infrared lasers used as offensive signals, or sunlight if used outdoors. Players may adjust such optical protection devices through physical setup of the vehicle, or control them through control consoles, control subsystems, and drive components in like manner as the adjustments to offensive components and sensors discussed previously. Camera components 290, optical protection devices, and the software which supports the operation of camera components 290 and the capture and transmission of image data, may be modularized such as previously described.

Figure 8:
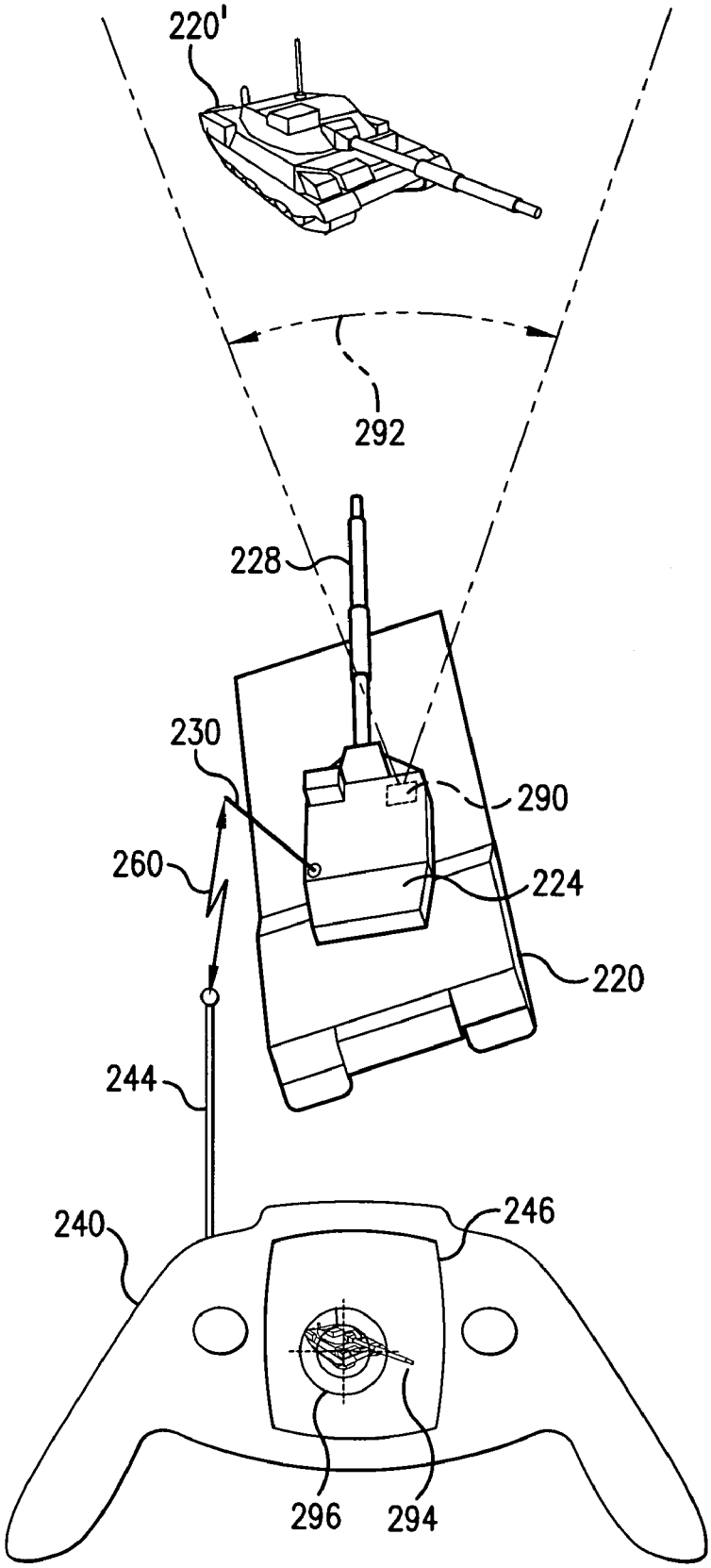
FIG. 8 shows a control console of one remote control game system with selective component disablement, in accord with an embodiment and displaying an image produced by a vehicle-mounted camera.

FIG. 8 shows one control console 240 of one remote control game system with selective component disablement, displaying an image produced by a camera component 290. As in FIG. 7, vehicle 220 includes a camera component 290, mounted on turret 224. In FIG. 8, turret 224 and thus camera component 290 are pointed towards another vehicle 220'. Camera component 290 delivers image data corresponding to a field of view indicated by arc 292 to a control subsystem, which in turn transmits the image data through antenna 230 into wireless signals 260. Control console 240 receives the image data in wireless signals 260 through antenna 244 and displays it on display 246. Image 294, a gunner's view image, is shown in display 246, and shows vehicle 220'. Also shown in display 246 is image overlay 296, in this case, a target indicating the direction in which gun 228 is pointed.

Accordingly, and in one embodiment, a player uses his field of view to target an opponent vehicle. When the player sights the opponent vehicle through the player's camera, he then "fires" an offensive component (e.g., the tank gun). The internal software of the player's vehicle or control console determines whether the shot reaches the opponent's vehicle, due to the field of view and trajectory of the shot, and a hit is registered. The hit is then relayed to the opponent's vehicle or control console (or both) through wireless signals. The opponent therefore learns of his vehicle's injury or disablement through the wireless signals, and without vehicle sensors.

Displays 246 of control consoles 240 may present camera images in addition to, or in place of, other displays. Large displays 246 may be operable as split screens or other forms of sharing display space between images and other items such as game area map displays, gunner's view renderings or images, and points or other game-related quantities. Control console 240 software may be capable of overlaying graphic effects on the displayed image. For example, in FIG. 8, a display of an image taken by camera component 290 mounted on turret 224 of vehicle 220 includes image overlay 296 indicating the object that gun 228 is pointed at, despite the body of vehicle 220 being pointed in a different direction. Other aids for aiming offensive components can also be implemented with image overlays 296, such as tilt compensation for the effect of gravity upon a simulated trajectory, as previously discussed.

Software 82, 182 may include image recognition capability for identifying images of vehicles, and overlay displayed vehicle images with indicators of whether a vehicle is "friend" or "enemy", and game-related quantities of the vehicle in the image. Software 82, 182 may enable player controls to interact with the image as a GUI (e.g., enabling a control console 40, 140 to determine and issue movement and firing commands based on a player's indication of the desired movement or firing, with a tracking device on a display 46, 146).

Figure 9:
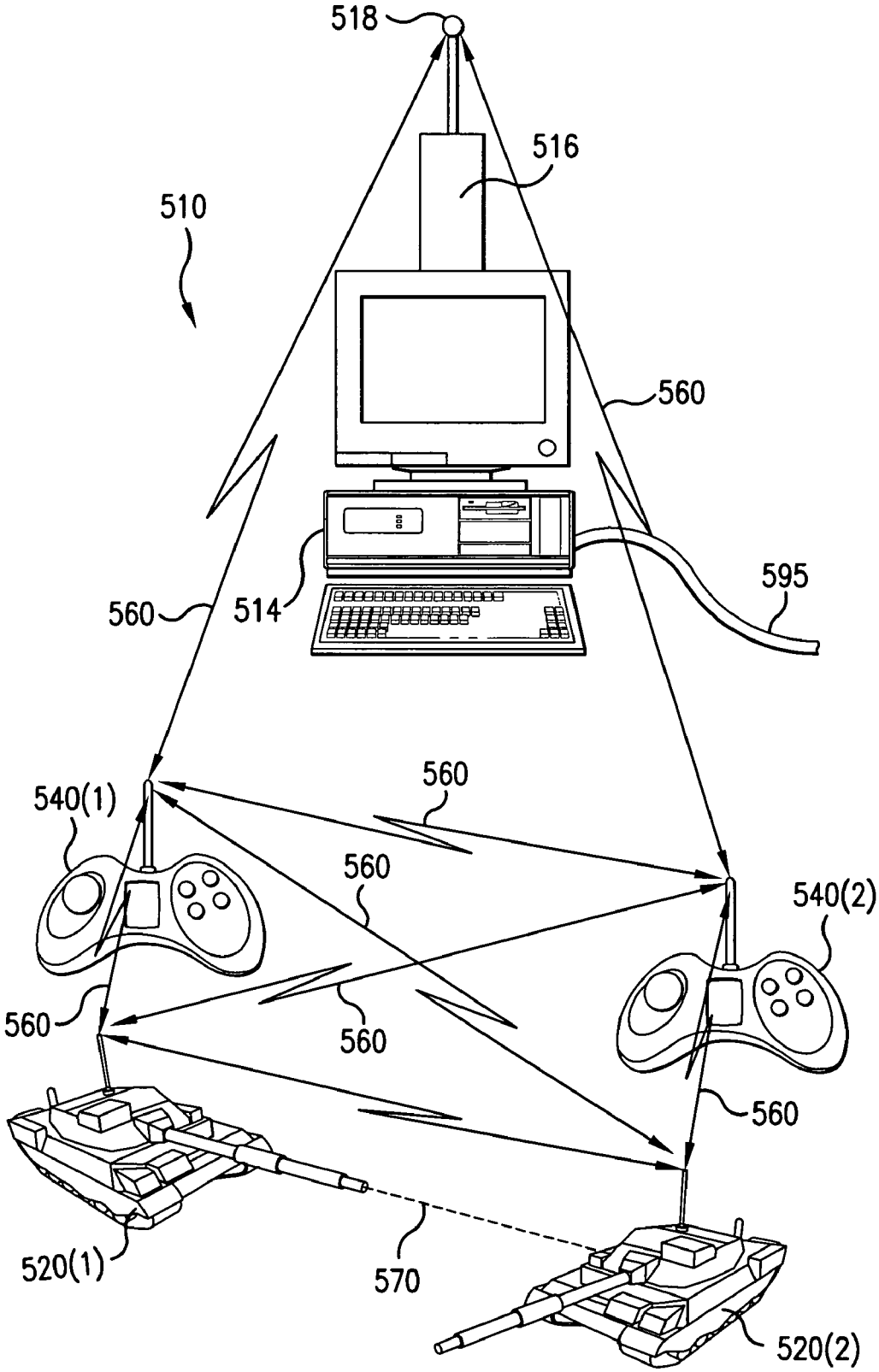
FIG. 9 shows one remote control game system with selective component disablement, in accord with an embodiment.

FIG. 9 shows one remote control game system 510 with selective component disablement. In game system 510, a computer 514 uses an RF electronics module 516 and antenna 518 to transmit and receive game data to and from vehicles 520 and control consoles 540, through wireless signals 560. In this embodiment, computer 514, vehicles 520 and control consoles 540 communicate with each other through wireless signals 560; some of these communication paths are shown in FIG. 9 while others have been omitted for clarity within the drawing. Computer 514 also connects to network connection 595 and may communicate game data through network connection 595 (e.g., to and from the Internet).

One or more players use a keyboard, mouse, and/or other input devices to control computer 514, which in turn directs the activity of vehicles 520 and/or control consoles 540. A computer monitor may provide any of the displays as previously described, in addition to displays available through control consoles 540.

Two or more players may use a single computer 514, in which case it is equipped with sufficient input devices and electronics for transmitting and receiving data, to support the input and communication needs of all vehicles 520 controlled by the players. Alternatively, for example, a player may control vehicle 520(1) through the use of control console 540(1), while computer 514 controls a vehicle 520(2), (e.g., through control console 540(2)), executing a preset list of commands (e.g., the player plays vehicle 520(1) against a "dummy opponent," computer 514, which controls vehicle 520(2)).

Network 595 facilitates other embodiments of the game system of FIG. 9. For example, a first vehicle may operate in an orientation-enabled embodiment at a first physical location, engaging in a virtual battle with a second vehicle operated in an orientation-enabled embodiment (representing the same terrain) at a second physical location, with the two control consoles transmitting game data to each other over network 595. The respective control consoles (or computers) calculate hits based on the position and orientation of a firing vehicle in the game area of one physical location, and the position and orientation of an opposing vehicle in the game area of the other physical location. Computers, control consoles, and vehicles may download software, software upgrades, or battle plans via networks.

The remote control vehicles described herein are not limited to simulated tanks, but may be a vehicle equipped with drive components, offensive components, sensors, control subsystems, and other items described herein. For example, the vehicles could be boats or any other marine vehicle, airplanes, blimps, helicopters, gliders or any other airborne vehicle, spaceships, cars, trains, or any other land vehicle, or amphibious vehicles. Software 80, 180, 82 and/or 182 may be configured to simulate operation of a type of vehicle in a manner that a user of a game system would associate with a vehicle of that type. For example, software 80, 180, 82 and/or 182 may control marine or amphibious vehicles including simulating marine drive components such as propellers and/or sails, and/or simulating a marine vehicle taking on water or sinking. Software 80, 180, 82 and/or 182 may control aircraft and/or spacecraft vehicles including simulating takeoffs, launches, airborne or space drive components, and/or landings. Software 80, 180, 82 and/or 182 may provide for emission of sounds from displays 146 and/or vehicle displays 127 that are (a) appropriate for a simulated vehicle or its environment of use, and/or (b) artificially created sounds for player enjoyment (e.g., synthesized sounds suggesting operation of spacecraft features).

Figure 10:
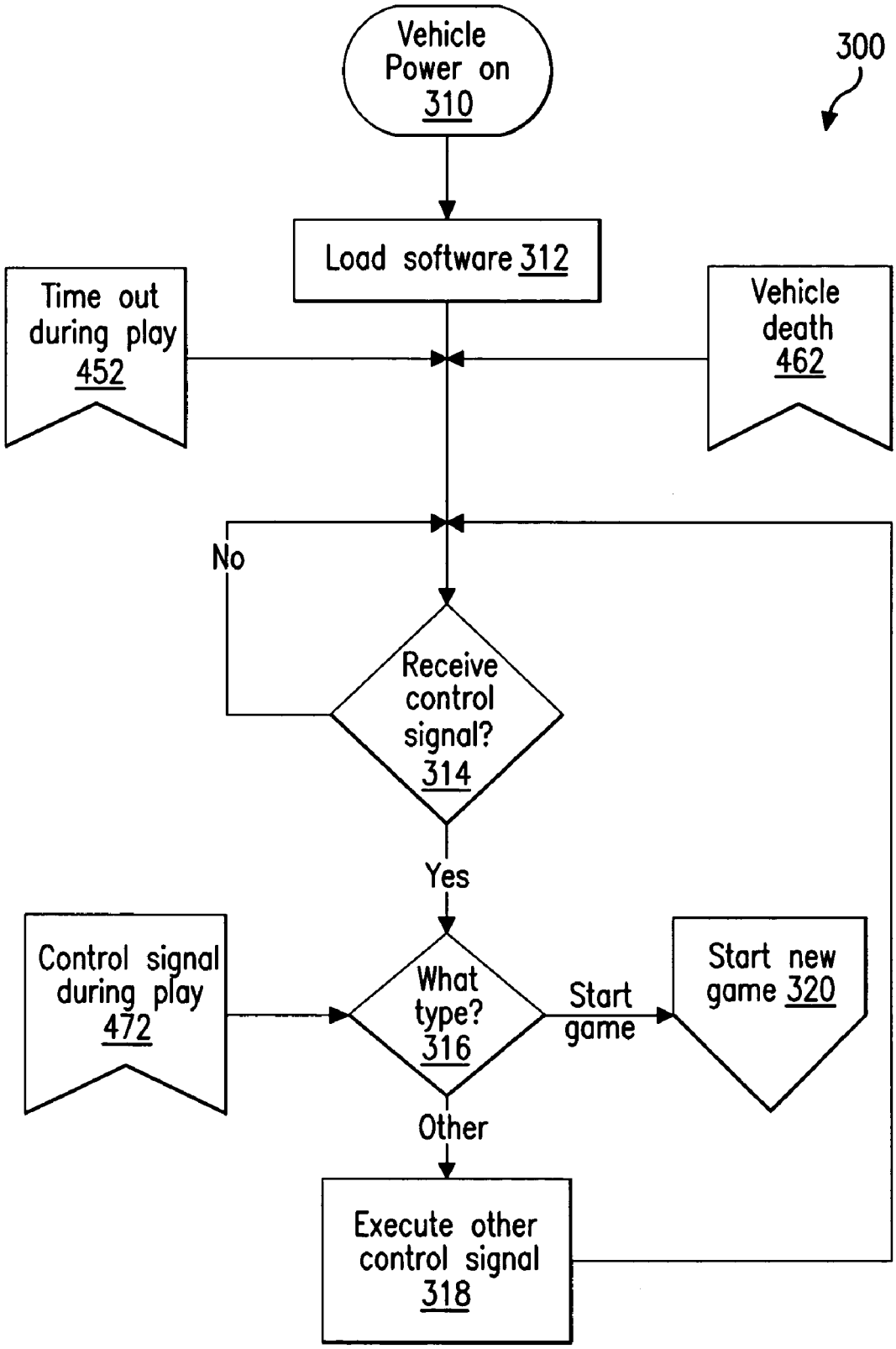
FIG. 10 is a flowchart illustrating exemplary steps of configuring a vehicle of one remote control game system with selective component disablement, in accord with an embodiment.

FIG. 10 is a flowchart illustrating one method 300, with the steps of configuring a vehicle of a remote control game system with selective component disablement. Method 300 is for example implemented by control subsystem 34 (via software 80) of vehicle 20 in FIG. 2. The terms used in describing the steps of the flowchart of FIG. 10 correspond to the terms used in FIG. 1 through FIG. 8. Method 300 begins with step 310, wherein an on/off mechanical switch is turned on. Step 312 loads software into the vehicle's CPU. Step 314 is a loop wherein the CPU waits until it receives a control signal from the vehicle's RF electronics. When a control signal is received during step 314, or during play of a game in step 472, control passes to step 316. Step 316 determines what type of control signal was received. If the control signal received is a "Start game" signal, control passes to step 320. If the control signal received is any other signal (e.g., a command to download software or configure the elements of the vehicle), step 318 executes the command, after which control passes back to step 314.

Figure 11A:
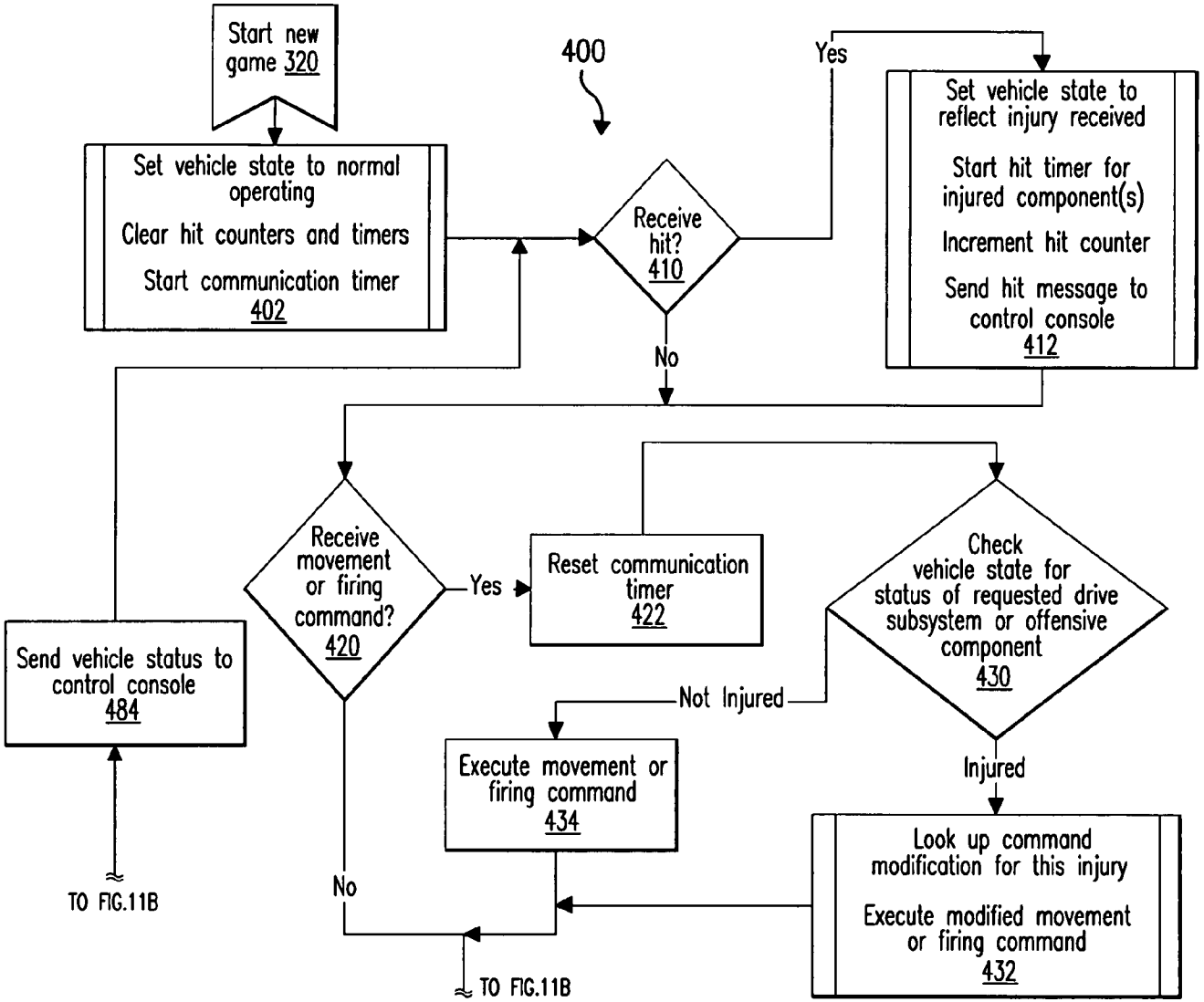
FIG. 11A and FIG. 11B show a flowchart illustrating exemplary steps performed by a vehicle of one remote control game system with selective component disablement, during a game and in accord with an embodiment.
Figure 11B:
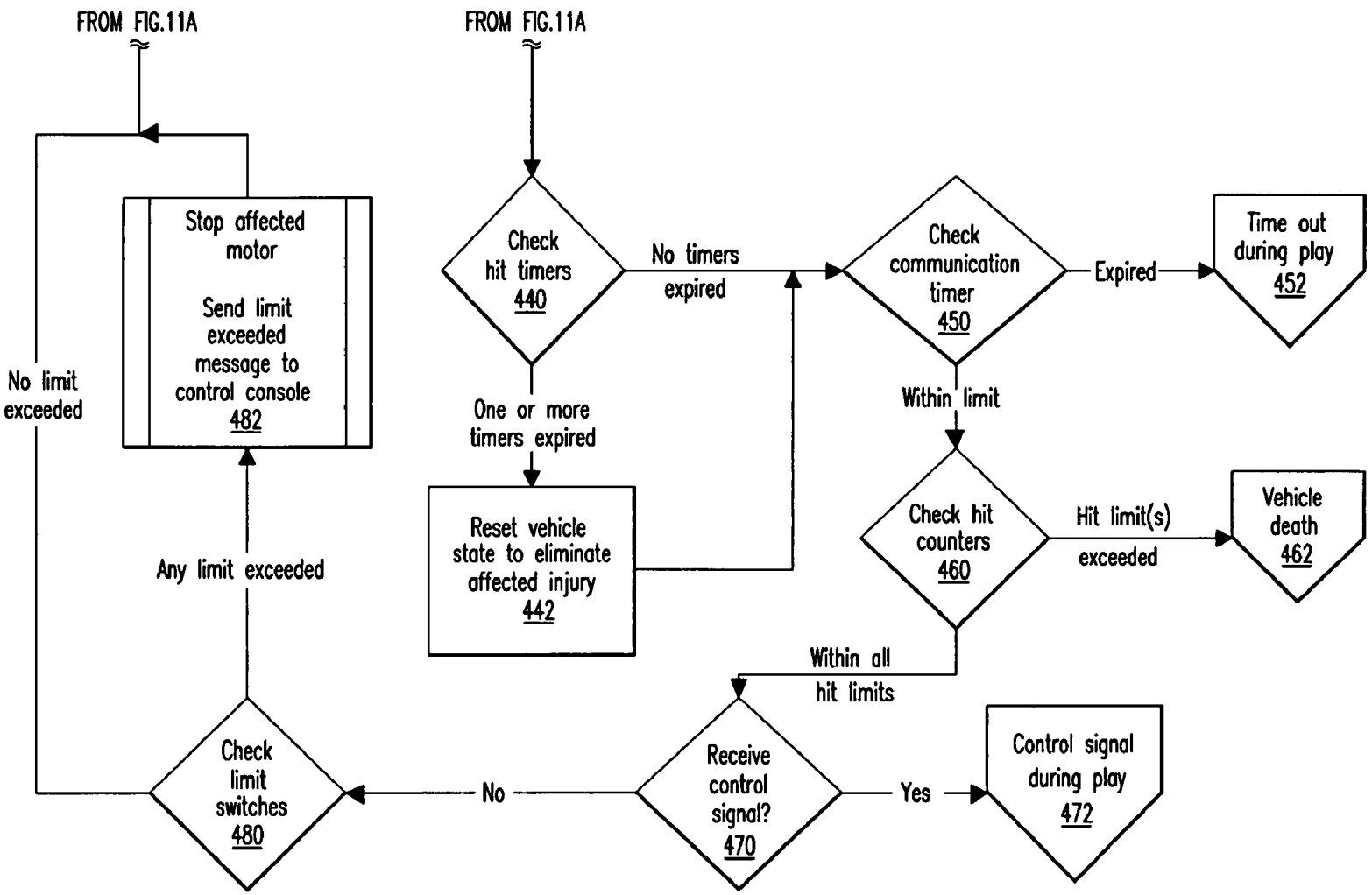

FIG. 11A and FIG. 11B show a flowchart illustrating one method 400 showing steps performed by a vehicle of a remote control game system with selective component disablement, during a game and in accord with one embodiment. Method 400 is for example implemented by control subsystem 34 (via software 80) of vehicle 20 in FIG. 2. Method 400 begins with step 320 of FIG. 10, wherein a "Start game" command is received by a vehicle. Step 402 sets the vehicle into a normal operating state, (e.g., resets the states of all drive components and offensive components to fully operational, and clears all counters and timers associated with hits). Step 402 also starts a communication timer. In step 410, the vehicle assesses the condition of its sensors to determine whether any have been hit. If a hit signal is received, step 412 (1) modifies the state of the vehicle to reflect injury to one or more affected drive components and/or offensive components, (2) starts a hit timer to track the time of injury to the affected components, (3) increments the appropriate hit counter(s), and (4) sends a message describing the hit(s) is to the control console.

If no hit is received, or after step 412 is completed, step 420 assesses whether a movement or firing command has been received from the control console. If so, step 422 resets the communication timer and control passes to step 430, which assesses whether the drive component or offensive component subject to the command received in step 420 is in an injured state. If so, in step 432 the CPU looks up the appropriate command modification for the specific injury in place and executes the modified movement or firing command. If the drive component or offensive component subject to the command received in step 420 is not in an injured state, in step 434 the CPU executes the (unmodified) movement or firing command as received in step 420.

If no movement or firing command was received in step 420, or after such command was executed in step 432 or 434, control passes to step 440, which checks the hit timers. Expiry of any timer causes the CPU to reset the state of the vehicle in step 442, which in turn resets the states of the affected drive components and/or offensive components to fully operational. Control passes to step 450, wherein the communication timer is checked. If the communication timer has expired, (e.g., due to the control console being left unattended) control passes to step 452, "Time out during play", exiting the FIG. 11 flowchart of method 400 and re-entering the FIG. 10 flowchart of method 300, at step 314. If the communication timer has not expired, control passes to step 460 wherein the hit counters are checked. If one or more preset hit limits have been exceeded, control passes to step 462, "vehicle death", exiting the FIG. 11 flowchart of method 400 and re-entering the FIG. 10 flowchart of method 300, at step 314. If no hit limit has been exceeded, control passes to step 470, which assesses whether a movement or firing command has been received from the control console. If a control signal has been received, control passes to step 472, "Control signal during play", exiting the FIG. 11 flowchart of method 400 and re-entering the FIG. 10 flowchart of method 300, at step 316. If no control signal has been received, control passes to step 480, which assesses the vehicle's limit switches. If any limit switch has been actuated, step 482 stops the motor associated with the actuated limit switch, and sends a limit exceeded message to the control console. After step 482, or if no limit has been exceeded, step 484 sends a vehicle status message to the control console. This message includes at least the vehicle state, i.e., injured or not injured status of all sensors, but may also include status of hit counter(s), hit timer(s), the communication timer, and limit switches. After execution of step 484, control passes back to step 410.

The loop defined by steps 410, 420, 440, 450, 460, 470, and 480 may execute until the communication timer expires, hits exceed a hit limit, or receipt of a control signal interrupts play.

Although FIG. 10 and FIG. 11 show the sequence of steps in a particular order, other embodiments of the game system may change the sequence of these steps, or may add or delete steps. For example, steps 410, 420, 440, 450, 460, 470, 480 of FIG. 11, and the associated procedures triggered when the conditions of any of these steps are met, may be performed in any order. In a position-enabled embodiment of the game system, additional steps correspond to detecting and reporting vehicle position. In an orientation-enabled embodiment, additional steps correspond to detecting and reporting vehicle orientation.

Changes may be made in the above methods and systems without departing from the scope hereof. It should thus be noted that that the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall there between.

What is claimed is:

1. A remote control game system, comprising two or more game sets, each game set having one or more remote control vehicles and an associated control console, each of the remote control vehicles having:

a vehicle body;

one or more offensive components mounted with the vehicle body, each of the offensive components operable to communicate at least one offensive signal;

a plurality of sensors mounted with the vehicle body, each of the sensors located at a different area of the vehicle body and operable to detect an offensive signal thereupon and, in response thereto, generate a hit signal received from an offensive signal from a second source separate from the vehicle; and one or more drive components (a) responsive to commands from the control console, to move the vehicle body and operate the offensive components and (b) responsive to the hit signal, wherein the hit signal will degrade operation one of a particular one of the drive components and the offensive components while leaving operation of another one of the drive components and offensive components unaffected, based upon the location of the sensor generating the hit signal.

2. The system of claim 1, each set of remote control vehicles and associated control console being in wireless communication.

3. The system of claim 1, wherein the offensive signal comprises a light beam, and wherein at least one of the sensors comprises a detector that detects the light beam.

4. The system of claim 3, the light beam being modulated with encoded information, wherein at least one of the sensors is capable of decoding the information.

5. The system of claim 1, one or more of the remote control vehicles or control consoles being operable to interface with a network.

6. The system of claim 5, wherein software for one or more of the remote control vehicles or control consoles is downloaded from the network.

7. The system of claim 1, wherein at least one of the remote control vehicles simulates a tank, a boat, an airplane, a blimp, a helicopter, a glider, a spaceship, a car, a train, or an amphibious vehicle.

8. The system of claim 1, at least one of the remote control vehicles comprising one or more vehicle displays, each vehicle display operable to visually simulate one or more of light, sound, and smoke.

9. The system of claim 8, at least one of the vehicle displays being mounted adjacent to one of the sensors.

10. The system of claim 9, the at least one vehicle display being configured to indicate an injury state.

11. The system of claim 1, at least one of the control consoles being operable to calculate and display at least one game related quantity, the game related quantity comprising one or more of a score, time, shots fired, type of shot, hits, misses, injuries, kills, fuel and ammunition.

12. The system of claim 1, further comprising a game area, wherein the game area, the vehicles and the control consoles cooperate to determine a position of at least one of the vehicles in the game area, the position being communicated to at least one control console.

13. The system of claim 12, wherein the control console utilizes the position to generate a game area map display.

14. The system of claim 12, comprising at least one of a practice weapon and a practice target.

15. The system of claim 1, further comprising at least one digital camera, wherein at least one of the remote control vehicles being configured to transmit image data generated by the camera, wherein at least one control console is configured to display an image corresponding to the image data.

16. The system of claim 15, the control console configured to recognize images of opponent vehicles and overlay game related quantities adjacent to opponent vehicle images.

17. A computer readable medium storing a software product comprising instructions, wherein the instructions, when executed by a computer, perform steps for selectively disabling components of a first of at least two remote control vehicles, each of the vehicles having movement capability and firing capability comprising:

instructions for determining when one of a plurality of sensors on the first vehicle receives a hit from an offensive signal from a second vehicle; and instructions for degrading one of the first vehicle movement capability and the firing capability, based upon a location on the first vehicle of one of the plurality of sensors receiving the hit, while leaving the other of the first vehicle movement and firing capability unaffected.

18. The software product of claim 17, further comprising instructions for uploading software to the vehicle, wherein the software reconfigures game characteristics for the vehicle.

19. The software product of claim 17, further comprising instructions for responding to user input in a control console to command one or both of movement capability of and firing capability from the first vehicle.

20. The software product of claim 17, further comprising instructions for generating a laser beam, as the offensive signal, from a laser mounted with the second source, the second source being the second remote control vehicle.

21. The software product of claim 17, further comprising instructions for uploading software to a control console that controls the first vehicle, wherein the software configures game characteristics for the first vehicle.

* * * * *

UNITED STATES PATENT AND TRADEMARK OFFICE

CERTIFICATE OF CORRECTION

PATENT NO. : 7,704,119 B2
APPLICATION NO. : 11/061074
DATED : April 27, 2010
INVENTOR(S) : Janet E. Evans It is certified that error appears in the above-identified patent and that said Letters Patent is hereby corrected as shown below:

In the Specifications
Column 3, lines 29-30: "denited" should read --denoted--
Column 5, line 22: "a player to selects" should read --a player selects--
Column 5, line 29-30: "within for a vehicle" should read --within a vehicle--
Column 15, line 67: "the hits is to the" should read --the hits to the--
Column 16, line 64: "noted that that the matter" should read --noted that the matter--

In the Claims
Column 17, line 23: "degrade operation one of a" should read --degrade operation of a--

Signed and Sealed this
Fourth Day of June, 2013

Teresa Stanek Rea
*Acting Director of the United States Patent and Trademark Office*